US005230678A

United States Patent [19]

Kaiser, II

[11] Patent Number: 5,230,678

[45] Date of Patent: Jul. 27, 1993

[54] JUMP ROPE HAVING SPRINKLING MEANS, AND METHODS OF CONSTRUCTING AND UTILIZING SAME

[76] Inventor: Ronald R. Kaiser, II, 12060 Cavell, Livonia, Mich. 48150

[21] Appl. No.: 941,232

[22] Filed: Sep. 4, 1992

Related U.S. Application Data

[62] Division of Ser. No. 825,375, Jan. 24, 1992.

[51] Int. Cl.[5] ..... A63B 5/20

[52] U.S. Cl. ..... 482/82; 482/81; 472/13; 472/128

[58] Field of Search ..... 482/82, 81, 148; 472/13, 33, 128, 15, 51, 73, 91, 92, 93, 148

[56] References Cited

U.S. PATENT DOCUMENTS

| | | | |
|---|---|---|---|
| 2,723,121 | 11/1955 | Cartwright . | |
| 2,921,743 | 1/1960 | Westover . | |
| 3,107,916 | 10/1963 | Cooper . | |
| 3,170,171 | 2/1965 | Mayhew et al. . | |
| 3,326,551 | 6/1967 | Clarke . | |
| 3,363,898 | 1/1968 | Crovello | 482/82 |
| 3,481,600 | 12/1969 | Lang, Sr. et al. . | |
| 4,315,623 | 2/1982 | Granderson . | |
| 4,618,142 | 10/1986 | Joseph, Jr. | 482/82 |
| 4,736,945 | 4/1988 | Vinciquerra . | |
| 4,919,417 | 4/1990 | Poulas . | |
| 5,022,646 | 6/1991 | Kessler . | |
| 5,102,381 | 4/1992 | Danielak et al. | 482/82 |

FOREIGN PATENT DOCUMENTS

| | | | |
|---|---|---|---|
| 2249488A | 5/1992 | United Kingdom | 482/8 |

OTHER PUBLICATIONS

Skip-A-Roo by Coronet The Evening Star Washington D.C. Apr. 27 1965 pp. 8-22 Woodward and Lothrop 48282.

Placard attached to device purchased by appliant Feb. 4, 1992 trend masters, St. Louis, Mo. ©1991 "Rainbow Skip-'N'-Fun Water Spraying Jump Rope".

Placard attached to device purchased by applicant Sep. 1992, "Puddle Jumper" by Riva Sports, San Diego, Calif. © 1992.

*Primary Examiner*—Richard J. Apley
*Assistant Examiner*—Jerome Donnelly
*Attorney, Agent, or Firm*—Irving M. Weiner; Joseph P. Carrier; Pamela S. Burt

[57] ABSTRACT

An apparatus constructed to be used as a jump rope which includes a tube which sprays water upon a user jumping in a predetermined area. The apparatus includes a connection to a water source, a rod, a jump rope spray tube and handles rotatably affixed on the rod. The rod joins the ends of the spray tube. The handles slide upon the rod to adjust to the individual user arm span. A swivel member prevents twisting of the connection to a water source. The swivel member includes a release mechanism to permit use of the apparatus as a jump rope.

13 Claims, 3 Drawing Sheets

JUMP ROPE HAVING SPRINKLING MEANS, AND METHODS OF CONSTRUCTING AND UTILIZING SAME

CROSS REFERENCE TO RELATED APPLICATIONS

This is a divisional application of U.S. Ser. No. 825,375 filed Jan. 24, 1992, currently pending.

BACKGROUND OF THE INVENTION

1. Field of the Invention

The present invention relates to a jump rope constructed of hose or tube material and connectable to a water source. More particularly, the present invention provides an entertaining and refreshing toy for children and adults. The toy provides a refreshing spray of water over the person in the jumping region of the toy. On hot days, such a device would be an enjoyable method for cooling off children and adults.

The embodiment of the present application includes a swivel connection with a release mechanism to permit use of the device without water spray, if desired. A rod connects the ends of the jump rope hose portion. A pair of handles slide along and freely rotate about the rod. The handles adjust to the arm span of the user.

2. Description of the Relevant Art

It has been known to provide water in a tube used for jumping rope. The water was added to taken from the tube to vary the weight for greater aerobic workouts. It has also been known to include light reflecting particles in water in a tube used for jumping for entertainment purposes.

U.S. Pat. No. 4,919,417 discloses an opening for adding or removing water to adjust the weight of the jump rope apparatus.

U.S. Pat. No. 5,022,646 discloses a water filled tube including light reflecting particles used as a jump rope apparatus.

It has also been known to provide small apertures in hoses to permit the slow release of water to plants. These hoses are known in the gardening field as "soaker" hoses.

The present invention provides a jump rope including a refreshing spray.

SUMMARY OF THE INVENTION

The present invention may suitably comprise, consist of or consist essentially of a water supply means, a swivel means, a jump rope portion including apertures therein and a second handle. The swivel means may comprise a release mechanism for controlling the flow of water through the jump rope. Preferably, at least one impact protector is provided on the jump rope portion of the apparatus. A pair of handles are rotatably provided on a rod, the rod connecting the ends of the jump rope hose portion.

It is an object of the present invention to provide a water filled jump rope including a spray of water onto the person in the "jump" area.

It is a further object of the present invention to provide a tangle free hose.

It is a further object of the present invention to provide an on/off control of the water spray.

It is a further object of the present invention to provide an apparatus having adjustable handles.

The above and further objects, details, and advantages of the invention will become apparent from the following detailed description, when read in conjunction with the accompanying drawings.

DETAILED DESCRIPTION OF THE PREFERRED EMBODIMENT

Figure 1:
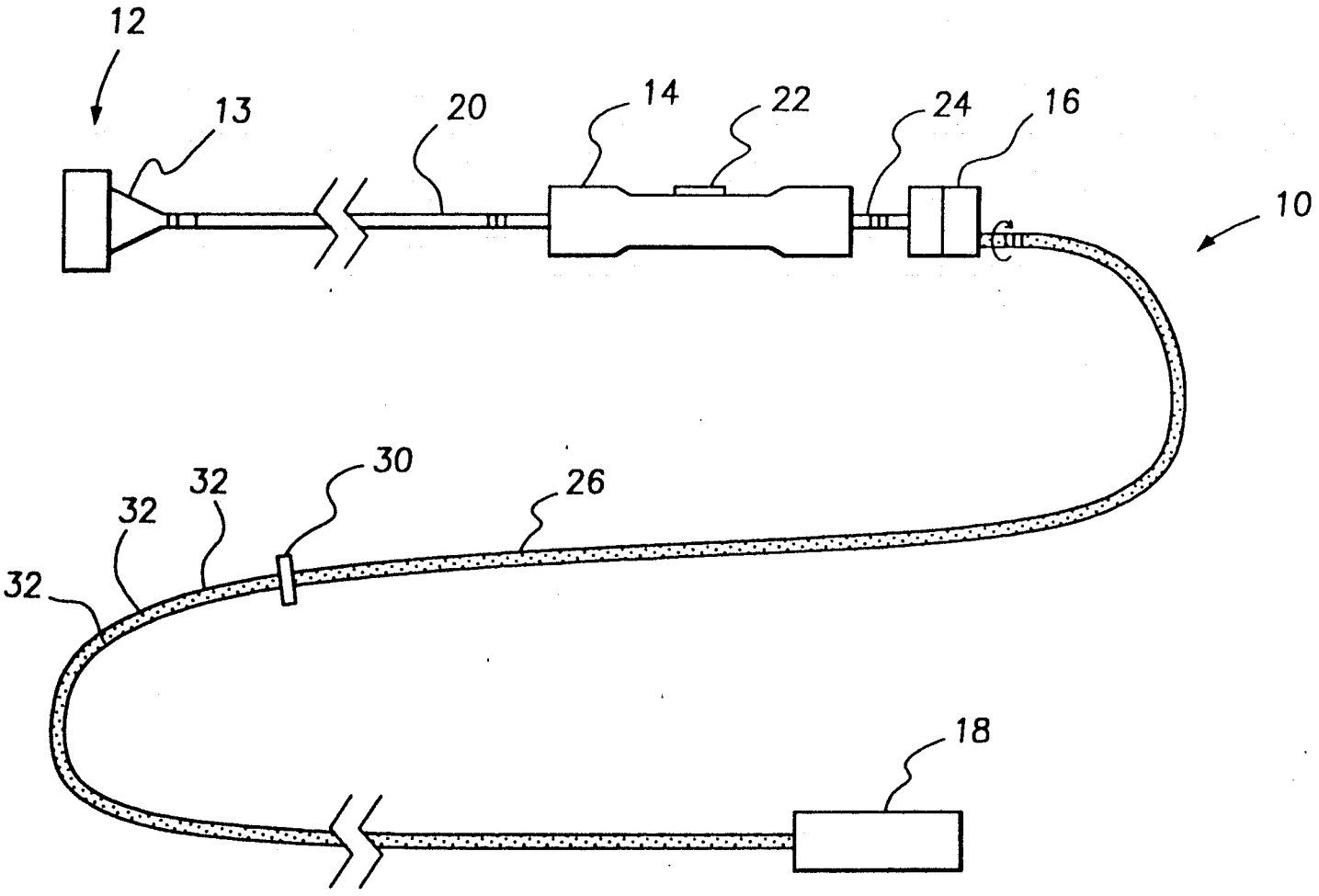
FIG. 1 illustrates a jump rope apparatus in accordance with the present invention.

Referring now to the drawings, and more particularly to FIG. 1 thereof, an apparatus 10 in accordance with the first embodiment of the present invention is shown. The apparatus 10 includes a water supply means 12, a first handle 14, swivel means 16 and a second handle 18, each connected by a length of hose or tubing. The length of hose or tubing is preferably separated into distinct portions as set forth below.

The water supply means 12 is preferably provided at a first end with a female threaded connection to facilitate connection to a water source such as a common lawn and garden water hose (not shown) for providing a flow of water through the hoses of the apparatus 10. Other types of connections to the water source are possible. The water supply means 12 may include a tapered portion 13 for reducing the size of the water supply hose to a desired size and includes secured thereto a length of tubing 20.

Figure 2:
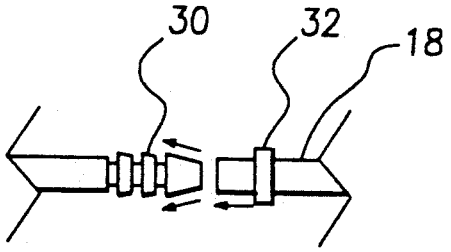
FIG. 2 illustrates a hose connection between the hose or tube and a plastic member of the apparatus.
Figure 3:
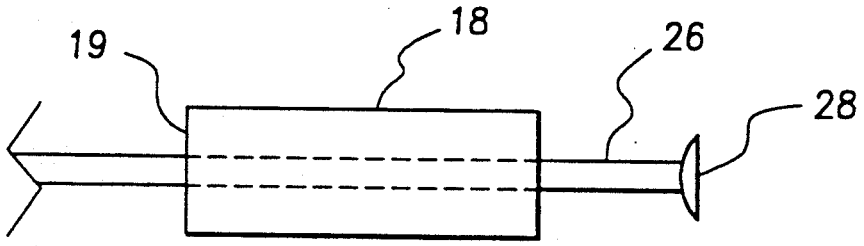
FIG. 3 illustrates the hose end second handle construction.

The first tubing 20 is preferably secured using a friction fitting best seen in FIG. 2. The first tubing 20 is pressed onto and over expansion members 30 which are trapezoid shaped and utilizes the tubing's resiliency to secure it to the fitting. A clamp 32 may be included over the tubing and expansion members 30 to ensure a water tight and permanent attachment since the tubing may lose some resiliency over time and due to temperature extremes. The clamp 32 may be a spring-type clamp or a simple band sized to fit about the tubing and fitting. Preferably, all connections referred to in regard to the present apparatus 10 are of this type.

The first tubing 20 is connected to a first handle 14 at the handle 14 first end. Preferably, a means for controlling the water flow 22 is included on handle 14. Means 22 comprises an on/off switch and related internal components for permitting or blocking the flow of water through the handle 14 at a water exit. Handle 14 is shaped to facilitate grasping the handle 14 even under wet conditions and may optionally include texture thereon to enhance friction. The handle 14 may further include grooves or indentations to enhance the ability to hold the handle in a user's hand.

Handle 14 includes a fitting at its second end for the attachment of a short section of second tubing 24 connecting the handle 14 with a swivel means 16. As discussed above, the fittings are of the type previously disclosed.

Swivel means 16 is provided to prevent twisting of the jump rope hose portion 26 which is connected to the swivel means 16 opposite the handle 14 connection. Swivel means 16 must freely turn in relation to the turning of the jump rope hose portion 26.

Figure 4:
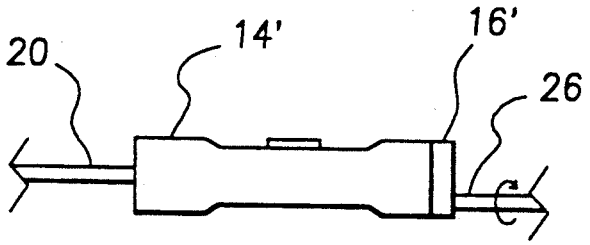
FIG. 4 illustrates a second embodiment of the first handle including a swivel portion.

As seen in FIG. 4, a handle 14' may include the swivel means 16' as an integral part thereof. The swivel means 16' in this embodiment, would be pivotally attached to the handle 14' to prevent twisting of the tubing 26.

It should be noted that first tubing 20 between water supply means 12 and first handle 14 is of such a length to permit the means 12 to rest on the ground when the handle 14 is of such a length to permit the means 12 to rest on the ground when the handle 14 is held by a user. This feature eliminates the weight of the water source garden hose from the handle 14 permitting the user comfortable manipulation of the apparatus 10.

Jump rope hose portion 26 extends from swivel 16 or 16' to an end having associated therewith a second handle 18. An end closure 28 is provided for hose portion 26 having a large end portion and a portion fitted within the tubing 26. An aperture in the handle 18 at end 19 permits the hose to pass therethrough but not the large end portion on the closure 28 thus securing the handle to the apparatus 10.

Preferably, hose portion 26 includes associated therewith at least one impact protector 30 to prevent the hose portion from contacting the ground surface during use of the apparatus 10 thus preventing unwanted wear and abuse to the hose portion 26. A predetermined area of hose portion 26 includes a series of apertures for releasing water upon the person "jumping rope" in this predetermined area. Thus, the predetermined area may be defined as the section of hose portion 26 which spins around a user of the apparatus.

The apertures 32 preferably are sized to provide a spray or mist of water in the predetermined area. However, a variety of aperture patterns and aperture sizes may be provided resulting in a variety of patterns for sprays. Preferably, the apertures 32 are 1/32 inch or 1/64 inch in diameter spaced at 6 inch intervals. The apertures 32 may be alternated at 90° to the previous apertures. The apertures 32 are formed by pressing a drill bit or similar device through the entire tube 26. A maximum number of apertures 32 will be reached before loss of water pressure prevents spray from being released towards the end of the tubing 26 adjacent second handle 18.

Figure 5:
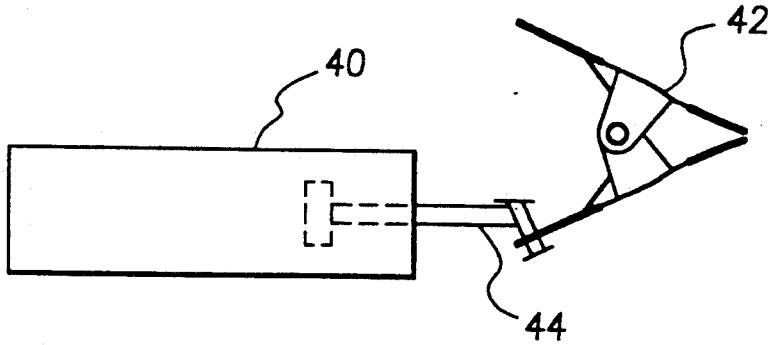
FIG. 5 illustrates an auxiliary handle.

As seen in FIG. 5, an auxiliary handle 40 may be provided to shorten the length of hose portion 26 for use of the apparatus 10 by a single person. The auxiliary handle 40 includes a clamp 42 which attaches the handle 40 to hose portion 26 without pinching off the water flow through the tubing. Handle 40 freely turns on support member 44 which attaches the handle 40 to clamp 42 in a manner similar to that described with respect to second handle 18.

Second handle 18 may optionally include a means for securing the hose portion 26 to stationary objects such as a fence or post (not shown).

In use, the apparatus 10 would be attached to a water source such as a garden hose. A first person would retain first handle 14, a second person would retain second handle 18 and a third person would stand adjacent the predetermined area. Either before the start of "jumping rope" or after the start of "jumping rope", the first person may turn on the water with means 22. The water then sprays upon the person in the jumping region "jumping rope" with hose portion 26.

If only two people are present, a first person may retain first handle 14 with the second handle secured to a stationary object such as a fence or post.

If a single person desires to utilize apparatus 10, auxiliary handle 40 may be attached to hose portion 26 between first handle 14 and the predetermined area. The user then retains handle 40 and handle 18 for turning hose portion 26 for use as a "jumping rope" as is well known. The water may be turned on before the user starts turning hose portion 26.

Having described the previous embodiment of the invention, the embodiment to be covered in the present application can now be clearly understood as described below.

Figure 6B:
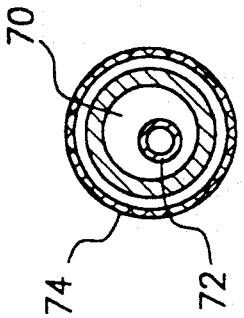
FIGS. 6, 6A and 6B illustrate a second embodiment of the present invention specifically designed for use by a single person.
Figure 6A:
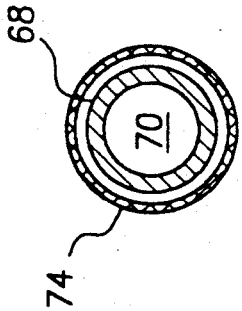
Figure 6:
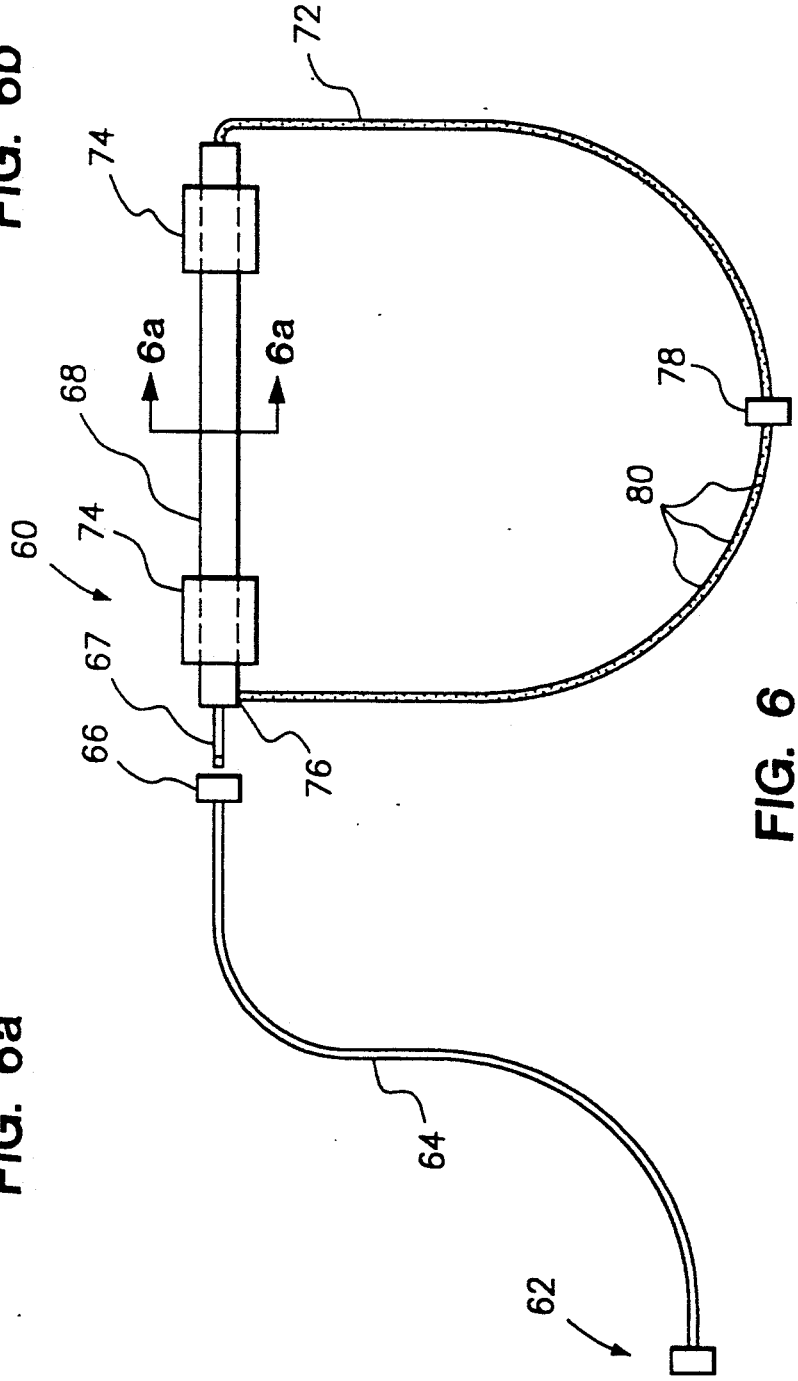

As best seen in FIG. 6, a second embodiment of a toy in accordance with the present invention is shown. The apparatus 60 is specifically designed for a single user wherein the apparatus 10 shown in FIG. 1 is capable of being used by one, two or three users.

Apparatus 60 includes a water supply means 62 comprising a threaded female connection for connection to a hose (not shown) as discussed above. Again, other types of connections are known and may be employed for connecting to a water source. A water supply tube 64 connects the water supply means to a swivel connection 66 which also includes a release mechanism to permit the apparatus to be used without the water supply means 62 and tube 64. The length of tube 64 is sufficient to permit use of the apparatus 10 without the weight of the water source on the apparatus 10 impeding the user, a preferred length is 6 feet.

The jumping portion of the apparatus 60 comprises a rod 68 having a central passageway 70 its entire length. A mating release mechanism 67 is provided at one end of rod 68 for connection to swivel connection 66. Mechanism 67 permits water to flow through the passageway to a jump rope hose portion 72 which is secured to the rod 68 at the second end which is the end of the rod opposite mechanism 67. Additionally provided on the rod 68 are a pair of handles 74 which freely turn upon and slide along rod 68 (note FIG. 6A).

The handles 74 adjust to the width of the armspan of the user by sliding along rod 68. The jump rope hose portion 72 is similar in construction to hose portion 26 discussed above with portion 72 having a plurality of apertures 80 therein for providing a spray of water in a predetermined area. Again, the predetermined area comprises the area most likely to be occupied by a person "jumping rope" over the hose portion 72. The hose portion 72 is closed and secured to the rod at its second end 76. An impact protector 78 is preferably provided on the hose portion 72 to prevent wear and tear on the hose.

As seen in FIG. 6B, the hose portion 72 may be a single piece extending from mechanism 67 through passageway 70 and exiting rod 68 to then comprise the jump rope hose portion. This construction would eliminate the need for multiple connections and leaks.

Although there has been described what is at present considered to be preferred embodiments of the invention, it will be understood that various modifications and variations may be made therein, and it is intended to cover in the appended claims all such modifications as fall within the true spirit and scope of the invention.

I claim:

1. Apparatus for use as a toy device known as a jump rope, said apparatus comprising: a rod means, said rod means having a passageway therein and having a first end and a second end; a swivel connection for securing a water supply means to said rod means at said rod's first end;

a jump rope hose portion having a first end and a second, said first end of said jump rope hose portion being operably attached to said second end of said rod means so as to allow a water flow from said passageway into said hose portion;

said second end of the hose portion being closed and secured to said rod at said rod's first end; said hose portion further including a plurality of apertures within said hose portion, located between its first and second ends, for providing a spray over a person using said jump rope; and handle means slidably and rotatably mounted on said rod means for allowing a user to swivel the hose portion of the device about the user so as to encompass the user between the rod means and a radius of the hose portion when in use.

2. The apparatus of claim 1, wherein:

a water supply means comprising a supply hose, capable of being attached to a water source at a first end thereof and a swivel connection at a second end thereof, said swivel connection attaching to a mating structure on said rod.

3. The apparatus of claim 2, wherein:

said supply hose being of sufficient length to permit said first end to remain in contact with the ground when said apparatus is in use.

4. The apparatus of claim 3, wherein:

said area between the first and second ends of said jump rope hose portion comprising a length of jump rope hose portion which corresponds to the area in which a user of said apparatus will occupy.

5. The apparatus of claim 4, wherein:

said swivel connection includes a release mechanism for disconnecting said water supply means.

6. The apparatus of claim 5, wherein:

said rod means includes a central passageway its entire length.

7. The apparatus of claim 6, wherein:

said jump rope hose portion includes a portion which is within said central passageway of said rod.

8. The apparatus of claim 7, wherein:

said jump rope hose portion includes at least one impact protector to protect said jump rope hose portion during use.

9. An apparatus for use as a toy device known as a jump rope said apparatus further capable of being used as a water spray device, said apparatus comprising a swivel connection for securing a water supply means to a jumping portion of said apparatus, said swivel connection preventing the twisting of said water supply means;

said jumping portion further comprising a rod having first and second ends and a central passageway;

a hollow jump rope hose portion extending from a connection with said swivel connection at said first end of said rod through said central passageway and out of said second end of said rod, said hose portion being closed at and secured to said first end of said rod, a length of said jump rope hose portion including a predetermined area located between its first and second ends, which further includes a plurality of apertures for release of a spray of water; and said rod being of a sufficient length so as to allow a user to rotate the hose portion of the device about the user, encompassing the user between the rod and the hose portion when in use.

10. The apparatus of claim 9, wherein:

said swivel connection includes a release mechanism.

11. The apparatus of claim 10, wherein:

a water supply means comprising a supply hose, capable of being attached to a water source at a first end thereof and said swivel connection at a second end thereof.

12. The apparatus of claim 11, wherein:

said supply hose is of a length sufficient to permit said first end to remain in contact with the ground when said apparatus is in use.

13. The apparatus of claim 12, wherein:

said predetermined area includes an impact protector.

* * * * *